US006300052B1

(12) United States Patent
Louwet et al.

(10) Patent No.: US 6,300,052 B1
(45) **Date of Patent: *Oct. 9, 2001**

(54) BINDERS FOR THERMOGRAPHIC MATERIALS

(75) Inventors: Frank Louwet, Diepenbeek; Huub Van Aert, Mortsel; Frank Ruttens, Overijse; Ivan Hoogmartens, Wilrijk, all of (BE)

(73) Assignee: Agfa-Gevaert (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/138,048

(22) Filed: Aug. 21, 1998

Related U.S. Application Data

(60) Provisional application No. 60/069,170, filed on Dec. 10, 1997.

(30) Foreign Application Priority Data

Sep. 17, 1997 (EP) ..... 97202873

(51) Int. Cl.[7] ..... G03C 1/498

(52) U.S. Cl. ..... 430/617; 430/528; 430/529; 430/531

(58) Field of Search ..... 430/619, 617, 430/531, 535, 536, 528, 529; 503/214

(56) References Cited

U.S. PATENT DOCUMENTS

| | | | |
|---|---|---|---|
| 4,123,274 | 10/1978 | Knight et al. | 96/66 |
| 4,504,575 | 3/1985 | Lee | 430/531 |
| 4,529,689 | 7/1985 | Lee | 430/534 |
| 4,828,971 | 5/1989 | Przezdziecki . | |
| 4,960,681 | 10/1990 | Aotsuka . | |
| 5,876,915 * | 3/1999 | Deroover et al. | 430/619 |

FOREIGN PATENT DOCUMENTS

| | | |
|---|---|---|
| 3635441 | 10/1986 | (DE) . |
| 0226953 | 7/1987 | (EP) . |
| 0678776 | 10/1997 | (EP) . |
| 94/16361 | 7/1994 | (WO) . |

OTHER PUBLICATIONS

Reasearch Disclosure # 19551, Jul., 1980.*

Database WPI; Section Ch. Week 8641; Derwent Publications Ltd., London, Great Britain; Class a14, AN 86–267419; XP002069548 and JP 61 193 142 A (Konishiroku Photo Ind. Co., Ltd.) *abstract*.

* cited by examiner

*Primary Examiner*—Thorl Chea
(74) *Attorney, Agent, or Firm*—Leydig, Voit & Mayer, Ltd.

(57) ABSTRACT

A substantially light-insensitive black and white thermographic material comprising a support and a thermosensitive element containing a substantially light-insensitive organic silver salt, a reducing agent therefor in thermal working relationship therewith and a binder, wherein the binder is a water-dispersible film-forming polymer having covalently bonded ionic groups and the thermographic material is thermally developable under substantially water-free conditions; and a process for producing the substantially light-insensitive black and white thermographic material comprising the steps of: producing an aqueous dispersion of the substantially light-insensitive organic silver salt; producing one or more aqueous coating compositions containing together the aqueous dispersion of the substantially light-insensitive organic silver salt, the reducing agent and the binder; and applying the one or more aqueous coating compositions to the support, thereby forming after drying the thermosensitive element.

16 Claims, No Drawings

BINDERS FOR THERMOGRAPHIC MATERIALS

The application claims the benefit of U.S. Provisional Application No. 60/069,170 filed Dec. 10, 1997.

FIELD OF THE INVENTION

The present invention relates to a substantially light-insensitive black and white thermographic material comprising a thermosensitive element including a binder having covalently bonded ionic groups.

BACKGROUND OF THE INVENTION

Thermal imaging or thermography is a recording process wherein images are generated by the use of thermal energy.

In thermography three approaches are known:

1. Direct thermal formation of a visible image pattern by image-wise heating of a recording material containing matter that by chemical or physical process changes colour or optical density.

2. Image-wise transfer of an ingredient necessary for the chemical or physical process bringing about changes in colour or optical density to a receptor element.

3. Thermal dye transfer printing wherein a visible image pattern is formed by transfer of a coloured species from an image-wise heated donor element onto a receptor element.

Most of the "direct" thermographic recording materials are of the chemical type. On heating to a certain conversion temperature, an irreversible chemical reaction takes place and a coloured image is produced. A wide variety of chemical systems has been suggested some examples of which have been given on page 138 of "Imaging Systems" by Kurt I. Jacobson-Ralph E. Jacobson, The Focal Press—London and New York (1976), describing the production of a silver metal image by means of a thermally induced oxidation-reduction reaction of a silver soap with a reducing agent.

DE 3635441 discloses a process for producing an image, characterized in that a thermally developable photosensitive material, comprising a support with at least a photosensitive silver halide and a high molecular weight compound containing a repeating unit derived from a vinyl monomer with a —COOM-group and/or a —$SO_3M$-group, wherein M represents a hydrogen atom or an alkali metal atom, is heated, simultaneously or after image-wise exposure, in the presence of water and at least a base and/or a base-precursor.

JP 61-193142 discloses a heat development photosensitive material characterized in that in thermally developed photosensitive material which has a photosensitive layer containing at least silver halide particles on a support, the said photosensitive material has a layer which contains a water soluble or water dispersible block copolymer which has a polyvinyl alcohol system polymer as one component and a polymer which has an ionic group as the other component.

EP 678 776 discloses a thermally processable imaging element, said element comprising: (1) a support; and (2) a thermographic or photothermographic imaging layer on one side of said support; characterized in that said element additionally comprises (3) at least one electroconductive outermost layer comprised of electrically-conductive metal-containing particles dispersed in a polymeric binder in an amount sufficient to provide a surface resistivity of less than $5\times10^{11}$ ohms/square. However, there is no teaching in this document as regards thermographic materials based on organic silver salts and reducing agents.

WO 94/16361 discloses a multilayer heat-sensitive material which comprises: a colour-forming layer comprising: a colour-forming amount of finely divided, solid colourless noble metal or iron salt of an organic acid distributed in a carrier composition; a colour developing amount of a cyclic or aromatic organic reducing agent, which at thermal copy and printing temperatures is capable of a colour-forming reaction with the noble metal or iron salt; and an image-toning agent; characterized in that (a) the carrier composition comprises a substantially water-soluble polymeric carrier and a dispersing agent for the noble metal or iron salt and (b) the material comprises a protective overcoating layer for the colour-forming layer. In the description of WO 94/16361 are recited the following water-soluble polymeric carriers: polyvinyl alcohol, methyl cellulose, carboxy methyl cellulose, polysaccharide gums, gelatins, styrene butadiene copolymers, hydroxylated corn starch, acrylic latexes and blends and mixtures thereof. As dispersing agent the ammonium salt of styrene/acrylic acid is recited, with LUPASOL™ FF-3249 from BASF being used in the invention examples.

The inventors of the present invention found that thermographic materials containing conventional acrylic latexes coated from aqueous media exhibited poor archivability and poor light stability.

OBJECTS OF THE INVENTION

It is therefore an object of the present invention to provide thermographic materials coated from aqueous media which exhibit improved archivability and/or improved light stability, while maintaining high maximum density and low minimum density levels upon printing.

Further objects and advantages of the invention will become apparent from the description hereinafter.

SUMMARY OF THE INVENTION

It has been surprisingly found that black and white prints made with thermographic materials coated from an aqueous medium exhibit substantially improved archivability and increased light stability upon using water-dispersible film-forming polymers with covalently bonded ionic groups instead of the conventional acrylic latexes disclosed for this purpose in WO 94/16361.

The above-mentioned objects are realized by a substantially light-insensitive black and white thermographic material including a support and a thermosensitive element, containing a substantially light-insensitive organic silver salt, a reducing agent therefor in thermal working relationship therewith and a binder, wherein the binder is a water-dispersible film-forming polymer having covalently bonded ionic groups and the thermographic material is thermally developable under substantially water-free conditions.

A process is also provided, according to the present invention, for producing the substantially light-insensitive black and white thermographic material referred to above comprising the steps of: producing an aqueous dispersion of the substantially light-insensitive organic silver salt; producing one or more aqueous coating compositions containing together the aqueous dispersion of the substantially light-insensitive organic silver salt, the reducing agent and the binder; and applying the one or more aqueous coating compositions to the support thereby forming after drying the thermosensitive element.

Preferred embodiments of the present invention are disclosed in the detailed description of the invention.

DETAILED DESCRIPTION OF THE INVENTION

Substantially

By substantially light-insensitive is meant not intentionally light sensitive.

By thermally developable under substantially water-free conditions as used herein, means heating at a temperature of 80° to 250° C. under conditions in which the reaction system is approximately in equilibrium with water in the air, and water for inducing or promoting the reaction is not particularly or positively supplied from the exterior of the thermographic recording material. Such a condition is described in T. H. James, "The Theory of the Photographic Process", Fourth Edition, Macmillan 1977, page 374.

Aqueous

The term aqueous for the purposes of the present invention includes mixtures of water with water-miscible organic solvents such as alcohols e.g. methanol, ethanol, 2-propanol, butanol, iso-amyl alcohol, octanol, cetyl alcohol etc.; glycols e.g. ethylene glycol; glycerine; N-methyl pyrrolidone; methoxypropanol; and ketones e.g. 2-propanone and 2-butanone etc.

Water-dispersible Binder

The binder used according to the present invention is a water-dispersible film-forming polymer having covalently bonded ionic groups. The water-dispersible film-forming polymer having covalently bonded ionic groups used in the present invention is preferably a copolymer of an ionic monomer with covalently bonded anionic or cationic groups, for example:

Ionic monomer 1=potassium salt of N-[(4'-sulfobenzamido)-oxo-decyl]methacrylamide;

Ionic monomer 2=sodium salt of vinyl 2-sulfohexadecanoate;

Ionic monomer 3=ammonium N-(1',1'-dimethyl-2'-sulfoethyl)-acrylamide;

Ionic monomer 4=ammonium 2-sulfo-ethyl methacrylate;

Ionic monomer 5=HITENOLT™ A10 from INTOGRAM;

Ionic monomer 6=sodium salt of N-(2'-sulfoethylamino-oxo-decyl)methacrylamide;

Ionic monomer 7=sodium salt of 5-sulfo-isophthalic acid.

Ionic monomer 8=2-(N,N,N-triethylammonio)ethyl octyl maleate bromide

Ionic monomer 9=2-(N-allyl-N,N-diethylammonio)ethyl hexadecyl maleate bromide

Ionic monomer 10=N-[(11-methacryloyloxy)undecyl]-4-methyl-pyridinium bromide

Ionic monomer 11=1[N,N-dimethyl-N-(2-hydroxyethyl)-ammonio]-11-(methacryloyloxy)undecane Ionic monomer 12=1-(N,N-dimethyl-N-dodecyl-ammonio)-2-(methacryl-oyloxy)ethane.

The water-dispersible film-forming polymer having covalently bonded ionic groups used according to the present invention preferably contains crosslinkable groups, for example: aceto-acetoxy-groups, epoxy-groups and double bonds.

The water-dispersible film-forming polymer having covalently bonded ionic groups used according to the present invention is preferably a polymer latex.

The water-dispersible film-forming polymer having covalently bonded ionic groups used according to the present invention preferably has covalently bonded moieties with one or more acid groups or anhydrides thereof, which are preferably carboxylic acid groups, for example copolymers of acrylic acid, methacrylic acid, crotonic acid, itaconic acid, mesaconic acid, glutaconic acid, citraconic acid, aconitic acid, maleic acid, maleic anhydride and fumaric acid. Particularly preferred covalently bonded moieties with one or more carboxylic acid groups or anhydrides thereof are copolymers having monomer units selected from the group consisting of itaconic acid, mesaconic acid, glutaconic acid, citraconic acid, aconitic acid, maleic acid, maleic anhydride and fumaric acid.

The covalently bonded ionic groups of the water-dispersible film-forming polymer used according to the present invention are preferably selected from the group consisting of sulfonate, sulfinate, carboxylate, phosphate, quaternary ammonium, tertiary sulfonium and quaternary phosphonium groups. The term quaternary ammonium also includes heterocyclic quaternary ammonium groups for example pyridinium groups.

The water-dispersible film-forming polymer having covalently bonded ionic groups used according to the present invention preferably has monomer units selected from the group consisting of acrylates, methacrylates, styrene, diene monomers, vinyl esters, substituted vinyl esters, polycarboxylic acids, polyols and polyisocyanates.

Examples of binders which can be used according to the present invention are the CYDROTHANE™ polyurethane dispersions from CYTEC listed in table 1, which are fully reacted, high molecular weight polyurethane-polyurea polymers dispersed in water by neutralizing the ionic groups in the prepolymer backbone.

TABLE 1

| polymer latex nr | CYDROTHANE ™ | polymer latex nr | CYDROTHANE ™ |
|---|---|---|---|
| 1 | HP-1035 | 5 | HP-5035 |
| 2 | HP-2035 | 6 | HP-5135 |
| 3 | HP-3130 | 7 | HP-6035 |
| 4 | HP-4033 | | |

polymer latexes without carboxylic acid group-containing monomers in table 2 below:

TABLE 2

| polymer | Ionic monomer | | BA | S | MMA | LICAN | AAEMA | GMA |
|---|---|---|---|---|---|---|---|---|
| latex number | number | [% by wt.] | [% by wt.] | [% by wt.] | [% by wt.] | [% by wt.] | [% by wt.] | [% by wt.] |
| 8 | 1 | 5 | 95 | — | — | — | — | — |
| 9 | 1 | 5 | 70 | — | 25 | — | — | — |
| 10 | 1 | 5 | 60 | — | 35 | — | — | — |
| 11 | 1 | 5 | 42 | — | 53 | — | — | — |
| 12 | 1 | 5 | 44 | 50 | — | — | 1 | — |
| 13 | 1 | 1 | 42 | 50 | — | — | 7 | — |
| 14 | 1 | 5 | 42 | 50 | — | — | 3 | — |
| 15 | 1 | 3 | 40 | 50 | — | — | 7 | — |
| 16 | 1 | 5 | 40 | 50 | — | — | 5 | — |
| 17 | 1 | 5 | 38 | 50 | — | — | 7 | — |
| 18 | 1 | 5 | 33 | 55 | — | — | 7 | — |
| 19 | 1 | 2 | 33 | 50 | — | — | 15 | — |
| 20 | 1 | 5 | 33 | 47 | — | — | 15 | — |
| 21 | 1 | 5 | 70 | 25 | — | — | — | — |
| 22 | 1 | 5 | 60 | 35 | — | — | — | — |
| 23 | 1 | 5 | 42 | 53 | — | — | — | — |
| 24 | 1 | 5 | 35 | 60 | — | — | — | — |

TABLE 2-continued

| polymer latex number | Ionic monomer number | Ionic monomer [% by wt.] | BA [% by wt.] | S [% by wt.] | MMA [% by wt.] | LICAN [% by wt.] | AAEMA [% by wt.] | GMA [% by wt.] |
|---|---|---|---|---|---|---|---|---|
| 25 | 1 | 5 | — | 30 | — | 58 | 7 | — |
| 26 | 1 | 5 | — | 35 | — | 60 | — | — |
| 27 | 1 | 5 | 38 | 40 | 10 | — | 7 | — |
| 28 | 1 | 5 | 38 | 30 | 20 | — | 7 | — |
| 29 | 1 | 5 | 38 | — | 50 | — | 7 | — |
| 30 | 1 | 5 | 38 | 50 | — | — | — | 7 |
| 31 | 1 | 5 | 38 | — | 50 | — | — | 7 |
| 32 | 2 | 5 | 38 | 50 | — | — | 7 | — |
| 33 | 3 | 5 | 38 | 50 | — | — | 7 | — |
| 34 | 4 | 5 | 38 | 50 | — | — | 7 | — |
| 35 | 5 | 5 | 38 | 50 | — | — | 7 | — |
| 36 | 1 | 5 | 14 | 81 | — | — | — | — |
| 37 | 1 | 2 | 39.5 | 51.5 | — | — | 7 | — |
| 38 | 1 | 0.5 | 44.25 | 55.25 | — | — | — | — |
| 39 | 1 | 2 | 39.5 | 51.5 | — | — | — | — |

where: BA = butyl acrylate; S = styrene; MMA = methyl methacrylate; LICAN = LICAN ™ 270 (a vinyl trisalkylacetate); AAEMA = aceto-acetoxyethyl methacrylate; and GMA = glycidyl methacrylate;

polymer latexes with carboxylic acid group-containing monomers given in table 3 below:

TABLE 3

| polymer latex nr | Ionic monomer nr | Ionic monomer [% by wt] | BA [% by wt] | S [% by wt] | MAA [% by wt] | IA [% by wt] | AAEMA [% by wt] |
|---|---|---|---|---|---|---|---|
| 40 | 1 | 3 | 42 | 53 | — | 2 | — |
| 41 | 1 | 3 | 38 | 50 | — | 2 | 7 |
| 42 | 1 | 3 | 41 | 51 | — | 5 | — |
| 43 | 1 | 3 | 42 | 53 | — | 2 | — |
| 44 | 1 | 3 | 42 | 53 | 2 | — | — |

where: BA = butyl acrylate; S = styrene; MAA = methacrylic acid; IA = itaconic acid; and AAEMA = aceto-acetoxyethyl methacrylate;

and the polyester latexes given in table 4 below:

TABLE 4

| polymer latex nr | ionic monomer number | ionic monomer [mol %] | glycerine [mol %] | terephthalic acid [mol %] | isophthalic acid [mol %] | ethylene glycol [mol %] |
|---|---|---|---|---|---|---|
| 45 | 7 | 10 | 2.5 | 25 | 15 | 47.5 |
| 46 | 7 | 3.5 | 2.5 | 26.5 | 20 | 47.5 |
| 47 | 7 | 3.5 | — | 26.5 | 20 | 50 |
| 48* | 7 | 3.5 | — | 26.5 | 20 | 50 |
| 49 | 7 | 1 | 1 | 29 | 20 | 49 |
| 50 | 7 | 1 | — | 29 | 20 | 50 |

*Polymer latex 47 converted into the acid form

Auxiliary Binders

The water-dispersible film forming polymer having covalently bonded ionic groups used according to the present invention may be used with additional water-soluble and/or water-dispersible binders. Film-forming binders suitable for materials coated from solvent dispersions or solutions may be all kinds of natural, modified natural or synthetic resins or mixtures of such resins, wherein the organic silver salt can be dispersed homogeneously or dissolved.

Suitable water-soluble film-forming binders for use in thermographic materials according to the present invention are: polyvinyl alcohol, polyacrylamide, polyacrylic acid, polymethacrylic acid, polyvinylpyrrolidone, polyethyleneglycol, proteinaceous binders such as gelatin modified gelatins such as phthaloyl gelatin, polysaccharides, such as starch, gum arabic and dextran and water-soluble cellulose derivatives.

Suitable water-dispersible binders for use in the thermographic materials of the present invention may be any water-insoluble polymer e.g. water-insoluble cellulose derivatives, polyurethanes, polyesters and polymers derived from α,β-ethylenically unsaturated compounds such as after-chlorinated polyvinyl chloride, partially hydrolyzed polyvinyl acetate, polyvinyl alcohol, polyvinyl acetals preferably polyvinyl butyral, and homopolymers and copolymers produced using monomers selected from the group consisting of: vinyl chloride, vinylidene chloride, acrylonitrile, acrylamides, methacrylamides, methacrylates, acrylates, methacrylic acids, acrylic acids, vinyl esters, styrenes and alkenes; or mixtures thereof. It should be noted that there is no clear cut transition between a polymer dispersion and a polymer solution in the case of very small polymer particles resulting in the smallest particles of the polymer being dissolved and those slightly larger being in dispersion.

To improve the layer-forming properties of water-soluble and water-dispersible polymers, plasticizers can be incorporated into the polymers, water-miscible solvents can be added to the dispersion medium and mixtures of water-soluble polymers, mixtures of water-dispersible polymers, or mixtures of water-soluble and water-dispersible polymers may be used.

A preferred auxiliary binders for use together with the polymer having covalently bonded ionic groups in the thermosensitive element of the present invention is gelatin.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in a solid state in the recording layer at temperatures below 50° C., but upon heating becomes a plasticizer for the recording layer and/or a liquid solvent for at least one of the redox-reactants.

Thermosensitive Element

According to the present invention, a thermographic recording material is provided comprising a thermosensitive element including a substantially light-insensitive organic silver salt, an organic reducing agent therefor in thermal working relationship therewith and a binder. The element may comprise a layer system in which the ingredients are dispersed in different layers, with the proviso that the substantially light-insensitive organic silver salt and the organic reducing agent are in thermal working relationship with one another i.e. during the thermal development process the reducing agent must be present in such a way that it is able to diffuse to the substantially light-insensitive organic silver salt particles so that reduction of the organic silver salt can take place. The thickness of the thermosensitive element is preferably in the range of 1 to 50 μm.

Organic Silver Salts

Preferred substantially light-insensitive organic silver salts used in the present invention are silver salts of organic carboxylic acids and in particular silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the present invention. A process for producing a suspension of particles containing a substantially light-insensitive organic silver salt is disclosed in EP-A 754 969.

The weight ratio of binder used according to the present invention to organic silver salt weight is preferably in the range of 0.2 to 6.

Organic Reducing Agents

Suitable organic reducing agents for the reduction of the substantially light-insensitive organic silver salts are organic compounds containing at least one active hydrogen atom linked to O, N or C, such as is the case with: catechol; hydroquinone; aminophenols; METOL™; p-phenylenediamines; alkoxynaphthols, e.g. 4-methoxy-1-naphthol described in U.S. Pat. No. 3,094,417; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Auxiliary Reducing Agents

The above mentioned reducing agents, regarded as primary or main reducing agents, may be used in conjunction with so-called auxiliary reducing agents. Such auxiliary reducing agents are e.g. sterically hindered phenols, such as described in U.S. Pat. No. 4,001,026; bisphenols, e.g. of the type described in U.S. Pat. No. 3,547,648; or sulfonamidophenols as described in Research Disclosure 17842 published in February 1979, U.S. Pat. No. 4,360,581, U.S. Pat. No. 4,782,004 and in EP-A 423 891. The auxiliary reducing agents may be present in the imaging layer or in a polymeric binder layer in thermal working relationship thereto.

Other auxiliary reducing agents that may be used in conjunction with the above mentioned primary reducing agents are hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5,545,507 and U.S. Pat. No. 5,558,983; acrylonitrile compounds as disclosed in U.S. Pat. No. 5,545,515 and U.S. Pat. No. 5,635,339; 2-substituted malondialdehyde compounds as disclosed in U.S. Pat. No. 5,654,130; and organic reducing metal salts, e.g. stannous stearate described in U.S. Pat. Nos. 3,460,946 and 3,547,648.

Toning Agents

In order to obtain a neutral black image tone in the higher densities and neutral grey in the lower densities, thermographic recording materials according to the present invention may contain one or more toning agents. The toning agents should be in thermal working relationship with the substantially light-insensitive organic silver salt and reducing agents during thermal processing. Any known toning agent from thermography or photothermography may be used. Suitable toning agents are the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type described in GB-P 1,439,478, U.S. Pat. No. 3,951,660 and U.S. Pat. No. 5,599,647.

Surfactants and Dispersants

Surfactants and dispersants aid the dispersion of ingredients which are insoluble in the particular dispersion medium. The thermographic recording materials of the present invention may contain one or more surfactants, which may be anionic, non-ionic or cationic surfactants and/or one or more dispersants.

Examples of suitable surfactants are:

- Surfactant Nr. 1=HOSTAPAL™, a sodium trisalkylphenyl-polyethyleneglycol(EO 7-8)sulphate from HOECHST;
- Surfactant Nr. 2=MERSOLAT™ H80, a sodium hexadecylsulfonate from BAYER;
- Surfactant Nr. 3=ULTRAVON™ W, a sodium arylsulfonate from CIBA-GEIGY;
- Surfactant Nr. 4=NIAPROOF ANIONIC™ 4, a sodium 1-(2'-ethylbutyl)-4-ethylhexylsulphate from NIACET;
- Surfactant Nr. 5=MARLON™ A-396, a sodium alkylphenylsulfonate from HÜLS;
- Surfactant Nr. 6=HOSTAPAL™ W, a nonylphenylpolyethylene-glycol from HOECHST.

Suitable dispersants are natural polymeric substances, synthetic polymeric substances and finely divided powders, for example finely divided non-metallic inorganic powders such as silica.

A feature of the thermographic recording materials of the present invention is the possibility of reducing the concentration of dispersion aids in the thermosensitive element, due to the use of water-dispersible film-forming polymers having covalently bonded ionic groups.

Stabilizers and Antifoggants

In order to obtain improved shelf-life and reduced fogging, stabilizers and antifoggants may be incorporated into the thermographic and photothermographic materials of the present invention.

Other Ingredients

In addition to the ingredients the thermographic material may contain other additives such as free fatty acids, silicone oil, ultraviolet light absorbing compounds, white light reflecting and/or ultraviolet radiation reflecting pigments, silica, and/or optical brightening agents.

Support

The support for the thermographic material according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated heat-sensitive recording layer. The support may be made of an opacified resin composition.

Protective Layer

A protective layer may also be provided for the thermosensitive element. In general this protects the thermosensitive element from atmospheric humidity and from surface damage by scratching etc. and prevent s direct contact of printheads or heat sources with the recording layers. Protective layers for thermosensitive elements which come into contact with and have to be transported past a heat source under pressure, have to exhibit resistance to local deformation and good slipping characteristics during transport past the heat source during heating.

The protective layer may comprise a dissolved lubricating material and/or particulate material, e.g. talc particles, optionally protruding therefrom. Examples of suitable lubricating materials are a surface active agent, a liquid lubricant, a solid lubricant or mixtures thereof, which may be used with or without a polymeric binder. Suitable slipping layer compositiors are described, for example, in U.S. Pat. No. 5,587,350, U.S. Pat. No. 5,536,696, U.S. Pat. No. 5,547,914, WO 95/12495, EP-A 775 592 and EP-A 775 595.

Coating

The coating of any layer of the thermographic materials of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, USA.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing, image signals are converted into electric pulses and then through a driver circuit selectively transferred to a thermal printhead. The thermal printhead consists of microscopic heat resistor elements, which convert the electrical energy via the Joule effect into heat, which is transferred to the surface of the thermographic material wherein the chemical reaction resulting in the development of a black and white image takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulse-wise. When used in thermographic recording operating with thermal printheads the thermographic materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into the material. Image- or pattern-wise heating of the thermographic material may also proceed by means of pixelwise modulated ultra-sound, using e.g. an ultrasonic pixel printer as described e.g. in U.S. Pat. No. 4,908,631.

Industrial Application

Thermographic materials according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

The following examples and comparative examples illustrate the present invention. The percentages and ratios used in the examples are by weight unless otherwise indicated.

i) Subbing Layer Ingredients:

PAREZ RESIN™ 707: a 80% solids melamine-formaldehyde resin from AMERICAN CYANAMID;

HORDAMER™ PE02: a 40% aqueous dispersion of polyethylene from HOECHST;

ii) Thermosensitive Element Ingredients:

K7598=Type 7598, a calcium-free gelatin from AGFA-GEVAERT GELATINEFABRIEK vorm. KOEPFF & SOHNE;

AgBeh=silver behenate

R01=catechol

R02=ethyl 3,4-dihydroxybenzoate

T01=7-(ethylcarbonato)benzo[e][1,3]oxazine-2,4-dione and the following representative conventional acrylic latexes in the COMPARATIVE EXAMPLES, according to the teaching of WO 94/16361:

| polymer latex nr | B [% by wt] | BA [% by wt] | S [% by wt] | MMA [% by wt] |
|---|---|---|---|---|
| C1 | — | 50 | 50 | — |
| C2 | — | 47 | — | 53 |
| C3 | — | 51 | — | 49 |
| C4 | 50 | — | — | 50 |
| C5 | — | 44.5 | 55.5 | — |
| C6 | — | 15 | 85 | — |

where: B = butadiene; BA = butyl acrylate; S = styrene; and MMA = methyl methacrylate together with the following dispersant, also according to the teaching of WO 94/16361:

DISPERSE™ AYD W22=a copolymer consisting of 50% by weight of styrene and 50% by weight of ammonium acrylate together with a non-ionic surfactant, from LETICA CORP., Rochester, Mich.

COMPARATIVE EXAMPLES 1 to 6 and INVENTION EXAMPLES 1 to 4

Preparation of a Silver Behenate Dispersion 71.5 g of dispersant nr 1, 187.5 g of a 10% aqueous solution of Surfactant nr 5 and 1741 g of deionized water were well mixed and then 500 g of silver behenate powder was added with stirring with a HOMOREX™ stirrer. Stirring was continued for 15 minutes after the addition of the silver behenate and then the resulting dispersion was stored for 24 hours in a refrigerator to allow the foam to dissipate. The dispersion was then stirred for 10 minutes with an ULTRA-TURRAX™ stirrer and then passed once through a MICROFLUIDICS™ microfluidizer at a pressure of 400 bar to obtain the final dispersion.

Preparation of the Silver Behenate Emulsion Layers

In the case of COMPARATIVE EXAMPLE 1 to 6 the coating dispersion was prepared by adding with stirring to the latex dispersion (for polymer latex number, quantity and concentration see table 5 and for surfactants present in the latex dispersion including those added during the preparation of the coating dispersion see table 7): 26.35 g of the 20% silver behenate dispersion at 40° C., deionized water (for quantity see table 5) and finally a 9.4% aqueous solution of Surfactant Nr. 3 (for quantity see table 5 and for surfactants present in the coating dispersion both from the latex dispersion and added during the preparation of the coating dispersion see table 7).

TABLE 5

| Comparative example number | polymer latex nr. | concentration of latex (%) | quantity of latex dispersion | quantity of water [g] | 9.4% solution of Surfactant Nr. 3 [g] |
|---|---|---|---|---|---|
| 1 | C1 | 34 | 15.6 | 27.1 | 1.0 |
| 2 | C2 | 36 | 15.1 | 28.6 | 0 |
| 3 | C3 | 20 | 25.7 | 16.9 | 1.0 |
| 4 | C3 | 33 | 15.9 | 26.8 | 1.0 |
| 5 | C3 | 20 | 25.9 | 16.8 | 1.0 |
| 6 | C3 | 21 | 25.3 | 18.1 | 0.25 |

In the cases of INVENTION EXAMPLES 1 to 4 the coating dispersion was prepared by adding with stirring to 26.35 g of the 20% silver behanate dispersion: latex dispersion (for polymer latex number, quantity and concentration see table 6 and for surfactants present in the coating dispersion both from the latex dispersion and added during the preparation of the coating dispersion see table 7), deionized water (for quantity see table 6), 1.4% aqueous solution of Surfactant Nr. 4 (for quantity see table 6) and finally ethanol (for quantity see table 6).

TABLE 6

| Invention example number | polymer latex nr. | concentration of latex (%) | quantity of latex dispersion [g] | quantity of water [g] | 1.4% solution of Surfactant Nr. 4 [g] | quantity of EtOH [g] |
|---|---|---|---|---|---|---|
| 1 | 18 | 21 | 25.5 | 6.2 | 2 | 5 |
| 2 | 20 | 20 | 25.8 | 5.9 | 2 | 5 |
| 3 | 25 | 20 | 26.1 | 5.5 | 2 | 5 |
| 4 | 26 | 20 | 26.3 | 5.4 | 2 | 5 |

The resulting emulsions for COMPARATIVE EXAMPLES 1 to 6 and INVENTION EXAMPLES 1 to 4 were then coated onto a polyethylene terephthalate support to a silver behenate coverage of approximately 7.9 g $m^2$ after drying for 10 minutes at 50° C.

Overcoating with Reducing Agent-containing Layer

The silver behenate emulsion layers were overcoated with a solution containing 2.64 g of K7598, 0.65 g of R01 (catechol) dissolved in 61.05 g of deionized water to which 0.3 g of a 1.4% solution of surfactant nr. 4 had been added to a R01 coating weight of 0.65 g/$m^2$ after drying for 10 minutes at 50° C.

Thermographic Printing

During printing of the recording materials of COMPARATIVE EXAMPLES 1 to 6 and INVENTION EXAMPLES 1 to 4 the printhead was separated from the imaging layer by a thin intermediate material contacted with a slipping layer of a separable 5 $\mu$m thick polyethylene terephthalate ribbon coated successively with a subbing layer, heat-resistant layer and the slipping layer (anti-friction layer) giving a ribbon with a total thickness of 6 $\mu$m.

The printer was equipped with a thin film thermal head with a resolution of 300 dpi and was operated with a line time of 19 ms (the line time being the time needed for printing one line). During this line time the printhead received constant power. The average printing power, being the total amount of electrical input energy during one line time divided by the line time and by the surface area of the heat-generating resistors was 1.6 mJ/dot, being sufficient to obtain maximum optical density in each of the thermographic materials of COMPARATIVE EXAMPLES 1 to 6 and INVENTION EXAMPLES 1 to 4

Image Evaluation

The maximum densities, $D_{max}$, and minimum densities, $D_{min}$, of the prints given in table 3 were measured through a blue filter with a MACBETH™ TR924 densitometer in the grey scale steps corresponding to data levels of 255 and 0 respectively and are given in table 7.

Archivability Test

The achivability of prints made with the thermographic materials of COMPARATIVE EXAMPLES 1 to 6 and INVENTION EXAMPLES 1 to 4 was evaluated on the basis of the change in minimum density upon heating the prints at 35° C. in a relative humidity (RH) of 80% for 3 days in the dark. The results of these tests are given in table 7.

Light Box Test

The stability of the image background of the prints made with the thermographic materials of COMPARATIVE EXAMPLES 1 to 6 and INVENTION EXAMPLES 1 to 4 was evaluated on the basis of the change in minimum (background) density measured through a blue filter using a MACBETH™ TR924 densitometer upon exposure on top of the white PVC window of a specially constructed light-box placed for 3 days in a VOTSCH conditioning cupboard set at 30° C. and a relative humidity (RH) of 85%. Only a central area of the window 550 mm long by 500 mm wide was used for mounting the test materials to ensure uniform exposure.

The stainless steel light-box used was 650 mm long, 600 mm wide and 120 mm high with an opening 610 mm long and 560 mm wide with a rim 10 mm wide and 5 mm deep round the opening, thereby forming a platform for a 5 mm thick plate of white PVC 630 mm long and 580 mm wide, making the white PVC-plate flush with the top of the light-box and preventing light loss from the light-box other than through the white PVC-plate. This light-box was fitted with 9 PLANILUX™ TLD 36W/54 fluorescent lamps 27 mm in diameter mounted length-wise equidistantly from the two sides, with the lamps positioned equidistantly to one another and the sides over the whole width of the light-box and with the tops of the fluorescent tubes 30 mm below the bottom of the white PVC plate and 35 mm below the materials being tested. The results are summarized in table 7.

TABLE 7

| | AgBeh cover-age [g/m²] | poly-mer latex num-ber | Surfactant Nr. | Surfactant [% by wt]* | Fresh $D_{max}/D_{min}$ (blue) | Archi-vability $\Delta D_{min}$ (blue) after 3d at 35° C./80% RH | Light Box $\Delta D_{min}$ (blue) after 3d at 30° C./85% RH |
|---|---|---|---|---|---|---|---|
| Compara-tive Example Nr | | | | | | | |
| 1 | 7.84 | C1 | 1 + 3 | 4 + 1.8 | 4.75/0.06 | +0.33 | +0.46 |
| 2 | 7.38 | C2 | 1 | 4 | 4.83/0.11 | +0.24 | +0.37 |
| 3 | 7.84 | C3 | 2 + 3 | 1 + 1.8 | 3.85/0.10 | +0.42 | +0.76 |
| 4 | 7.09 | C3 | 1 + 3 | 4 + 1.8 | 4.73/0.11 | +0.36 | +0.38 |
| 5 | 7.55 | C3 | 2 + 3 | 0.5 + 1.8 | 4.56/0.09 | +0.26 | +0.32 |
| 6 | 6.90 | C3 | 2 + 3 | 2 + 0.4 | 4.69/0.09 | +0.37 | +0.44 |
| Invention Example Nr | | | | | | | |
| 1 | 8.13 | 18 | 4 | 0.5 | 5.31/0.07 | +0.13 | +0.22 |
| 2 | 8.63 | 20 | 4 | 0.5 | 5.29/0.08 | +0.18 | +0.19 |
| 3 | 8.59 | 25 | 4 | 0.5 | 5.11/0.08 | +0.17 | +0.28 |
| 4 | 8.42 | 26 | 4 | 0.5 | 3.80/0.09 | +0.24 | +0.25 |

*with respect to the polymer latex

The results of the thermographic evaluation of the thermographic materials of INVENTION EXAMPLES 1 to 4 using binders which are water dispersible, film-forming polymers having covalently bonded ionic groups, according to the present invention, clearly demontrate their improved archivability and light box stability (=reduced $\Delta D_{min}$ values) compared with the thermographic materials of COMPARATIVE EXAMPLES 1 to 6 with conventional acrylic polymer latexes and stabilizing surfactants and dispersants according to the teaching of WO 94/16361.

INVENTION EXAMPLES 5 to 17

The silver behenate dispersion used in the preparation of the thermographic materials of INVENTION EXAMPLES 5 to 17 was prepared as described for COMPARATIVE EXAMPLES 1 to 6 and INVENTION EXAMPLES 1 to 4.

Preparation of the Thermographic Materials

In the case of INVENTION EXAMPLE 5 the coating dispersion was ed by adding with stirring to 24.42 g of the 20% silver behanate dispersion: 15.7 g of a 33.5% dispersion of polymer latex nr. 5, 22.91 g of deionized water, 2 g of a 9.4% aqueous solution of Surfactant 3 and 5 g of ethanol. In the cases of INVENTION EXAMPLES 6 to 17 the coating dispersion was prepared by adding with stirring to 24.42 g of the 20% silver behenate dispersion: latex dispersion (for polymer latex number, quantity and concentration see table 8 and for surfactants present in the coating dispersion both from the latex dispersion and added during the preparation of the coating dispersion see table 9), 9.4% acueous solution of Surfactant Nr. 3 (for quantity see table 8) and finally ethanol (for quantity see table 8).

TABLE 8

| Inven-tion example number | poly-mer latex nr. | concen-tration of latex (%) | quantity of latex dis-persion [g] | quantity of water [g] | 9.4% solution of Surfactant Nr. 3 [g] | quantity of EtOH [g] |
|---|---|---|---|---|---|---|
| 6 | 17 | 20 | 26.4 | — | 2 | 3 |
| 7 | 18 | 21 | 25.2 | — | 2 | 3 |
| 8 | 18 (core/shell) | 21 | 25.5 | — | 2 | 3 |
| 9 | 19 | 21 | 25.5 | — | 2 | 3 |
| 10 | 20 | 20 | 25.8 | — | 2 | 3 |
| 11 | 25 | 20 | 26.1 | — | 2 | 3 |
| 12 | 26 | 20 | 26.3 | — | 2 | 3 |
| 13 | 27 | 20 | 26.4 | — | 2 | 3 |
| 14 | 28 | 20.4 | 25.7 | — | 2 | 3 |
| 15 | 29 | 20 | 25.9 | — | 2 | 3 |
| 16 | 30 | 20.5 | 25.6 | — | 2 | 3 |
| 17 | 31 | 20.3 | 25.9 | — | 2 | 3 |

The resulting emulsions for INVENTION EXAMPLES 5 to 17 were then coated onto a 175 μm thick subbed polyethylene terephthalate support to a silver behenate coverage of approximately 4.15 g/m² after drying for 10 minutes at 50° C.

The silver behenate emulsion layers were overcoated with the reducing agent-containing layer used in COMPARATIVE EXAMPLES 1 to 6 and INVENTION EXAMPLES 1 to 4 to a R01 coating weight of 0.65 g/m².

Thermographic evaluation of the thermographic materials of INVENTION EXAMPLES 5 to 17 was carried out as described above for COMPARATIVE EXAMPLES 1 to 6 and INVENTION EXAMPLES 1 to 4 and the results are summarized in table 9 below.

TABLE 9

| Invent-ion Exam-ple Nr | AgBeh cover-age [g/m²] | poly-mer latex num-ber | Surfactant Nr. | Surfactant [% by wt]* | Fresh $D_{max}/D_{min}$ (blue) | Archiva-bility $\Delta D_{min}$ (blue) af-ter 3d at 35° C./80% RH | Light Box $\Delta D_{min}$ (blue) af-ter 3d at 30° C./85% RH |
|---|---|---|---|---|---|---|---|
| 5 | 4.56 | 5 | 3 | 3.6 | 2.89/0.07 | +0.16 | +0.26 |
| 6 | 4.11 | 17 | 3 | 3.6 | 4.51/0.05 | +0.08 | +0.07 |

TABLE 9-continued

| Invention Example Nr | AgBeh coverage [g/m²] | polymer latex number | Surfactant Nr. | Surfactant [% by wt]* | Fresh $D_{max}/D_{min}$ (blue) | Archivability $\Delta D_{min}$ (blue) after 3d at 35° C./80% RH | Light Box $\Delta D_{min}$ (blue) after 3d at 30° C./85% RH |
|---|---|---|---|---|---|---|---|
| 7 | 4.02 | 18 | 3 | 3.6 | 5.05/0.04 | +0.17 | +0.06 |
| 8 | 4.31 | 18# | 3 | 3.6 | 5.17/0.04 | +0.16 | +0.07 |
| 9 | 3.94 | 19 | 3 | 3.6 | 5.29/0.05 | +0.13 | +0.09 |
| 10 | 4.85 | 20 | 3 | 3.6 | 5.31/0.05 | +0.17 | +0.11 |
| 11 | 3.48 | 25 | 3 | 3.6 | 4.59/0.06 | +0.14 | +0.09 |
| 12 | 3.98 | 26 | 3 | 3.6 | 3.74/0.06 | +0.20 | +0.06 |
| 13 | 4.40 | 27 | 3 | 3.6 | 4.61/0.05 | +0.10 | +0.07 |
| 14 | 4.44 | 28 | 3 | 3.6 | 4.56/0.05 | +0.11 | +0.09 |
| 15 | 3.90 | 29 | 3 | 3.6 | 4.62/0.08 | +0.10 | +0.10 |
| 16 | 4.02 | 30 | 3 | 3.6 | 4.62/0.05 | +0.11 | +0.07 |
| 17 | 4.23 | 31 | 3 | 3.6 | 4.50/0.06 | +0.10 | +0.11 |

*with respect to the polymer latex
#core-shell

The results of the thermographic evaluation of the thermographic materials of INVENTION EXAMPLES 5 to 17 using binders which are water-dispersible film-forming polymers having covalently bonded ionic groups, according to the present invention, clearly demonstrate their improved archivability and light box stability (=reduced $\Delta D_{min}$ values) compared with the thermographic materials of COMPARATIVE EXAMPLES 1 to 6 with conventional acrylic latexes according to the teaching of WO 94/16361.

INVENTION EXAMPLES 18 to 23

The silver behenate dispersion used in the preparation of the thermographic materials of INVENTION EXAMPLES 18 to 23 were prepared as described for COMPARATIVE EXAMPLES 1 to 6 and INVENTION EXAMPLES 1 to 4.

Preparation of the Thermographic Materials

In the case of INVENTION EXAMPLES 18 to 21 the coating dispersion was prepared by adding with stirring to 26.35 g of the 20% silver behenate dispersion: 26.25 g of a 20% dispersion of polymer latex (for polymer latex nr., see table 10), 10.4 g of deionized water, 2 g of a 9.4% aqueous solution of surfactant 3 and 5 g of ethanol. The coating dispersions for INVENTION EXAMPLES 22 to 23 were prepared as for INVENTION EXAMPLES 18 to 21 except that 15.4 g of deionized water was added instead of 10.4 g and no ethanol (EtOH) was added.

The resulting emulsions for INVENTION EXAMPLES 18 to 23 were coated onto a 175 μm thick subbed polyethylene terephthalate support to a silver behenate coverage of approximately 7.1 g/m² after drying for 10 minutes at 50° C.

The silver behenate emulsion layers were overcoated with the reducing agent-containing layer used in COMPARATIVE EXAMPLES 1 to 6 and INVENTION EXAMPLES 1 to 4 to a R01 coating weight of 0.65 g/m².

Thermographic Evaluation

Thermographic evaluation of the thermographic materials of INVENTION EXAMPLES 18 to 23 was carried out as described above for COMARATIVE EXAMPLES 1 to 6 and INVENTION EXAMPLES 1 to 4 and the results are summarized in table 10 below:

TABLE 10

| Invention Example Nr | AgBeh coverage [g/m²] | polymer latex nr | Surfactant Nr. | Surfactant [% by wt]* | Fresh $D_{max}/D_{min}$ (blue) | Archivability $\Delta D_{min}$ (blue) after 3d at 35° C./80% RH | Light Box $\Delta D_{min}$ (blue) after 3d at 30° C./85% RH |
|---|---|---|---|---|---|---|---|
| 18 | 7.3 | 45 | 3 | 3.6 | 4.72/0.07 | +0.47 | +0.22 |
| 19 | 7.4 | 46 | 3 | 3.6 | 4.40/0.06 | +0.36 | +0.13 |
| 20 | 7.2 | 47 | 3 | 3.6 | 4.36/0.05 | +0.31 | +0.10 |
| 21 | 6.3 | 48 | 3 | 3.6 | 3.98/0.05 | +0.08 | +1.06· |
| 22 | 7.8 | 49 | 1 | 2 | 2.99/0.05 | +0.17 | +0.24 |
| 23 | 6.7 | 50 | 1 | 2 | 3.61/0.06 | +0.19 | +0.17 |

*with respect to the polymer latex
#added during preparation of coating dispersion
·due to coating emulsion having a too low pH The results of the thermographic evaluation of the thermographic materials of INVENTION EXAMPLES 18 to 20, 22 and 23 using binders which are water-dispersible film-forming polymers having covalently bonded ionic groups, according to the present invention, clearly demonstrate their improved archivability and light box stability =reduced $\Delta D_{min}$ values) compared with the thermographic materials of COMPARATIVE EXAMPLES 1 to 6 with conventional acrylic latexes according to the teaching of WO 94/16361.

INVENTION EXAMPLES 24 to 33

Preparation of a Silver Behenate Dispersion 107 g of DISPERSE™ AYD W22, 282.5 g of a 10% aqueous solution of Surfactant Nr 6 and 1360.5 g of deionized water were well mixed and then 750 g of silver behenate powder was added with stirring with a HOMOREX™ stirrer. Stirring was continued for 30 minutes after the addition of the silver behenate and then the resulting dispersion was stored for 24 hours in a refrigerator to allow the foam to dissipate. The dispersion was then stirred for 15 minutes with an ULTRA-TURRAXT™ stirrer and then stirred and then passed three times through a MICROFLUIDICST™ microfluidizer at a pressure of 400 bar to obtain the final dispersion.

Preparation of the Thermographic Materials

In the cases of INVENTION EXAMPLES 24 and 26 to 29 the silver behenate emulsion was prepared by adding with stirring to 17.5 g of the 32.6% silver behenate dispersion: 25.5 g of a polymer latex dispersion containing 5.25 g of solids (as indicated in table 11), 2 g of a 9.4% aqueous solution of Surfactant 3 and 2 g of ethanol. In the cases of INVENTION EXAMPLES 25 and 30 to 33 the coating dispersion was prepared by adding with stirring to 17.5 g of the 20% silver behenate dispersion: latex dispersion (for polymer latex number, quantity and concentration see table 11 and for the concentration of surfactant with respect to the latex added during the preparation of the coating dispersion see table 12), deionized water (for quantity see table 11), 9.4% aqueous solution of Surfactant Nr. 3 (for quantity see table 11) and finally ethanol (for quantity see table 11).

TABLE 11

| Invention example number | polymer latex nr. | concentration of latex (%) | quantity of latex dispersion [g] | quantity of water [g] | 9.4% solution of Surfactant Nr. 3 [g] | quantity of EtOH [g] |
|---|---|---|---|---|---|---|
| 25 | 10 | 21 | 25.2 | 3.3 | 2 | 2 |
| 30 | 17 | 20 | 26.4 | 2.2 | 2 | 2 |
| 31 | 32 | 21 | 25.5 | 3.0 | 2 | 2 |
| 32 | 34 | 19 | 28.3 | 0.2 | 2 | 2 |
| 33 | 35 | 20 | 26.1 | 2.4 | 2 | 2 |

The resulting emulsions for INVENTION EXAMPLES 24 to 33 were coated onto a polyethylene terephthalate support to a silver behenate coverage of approximately 4.15 g/m$^2$ after drying for 10 minutes at 50° C. The silver behenate emulsion layers were overcoated with the reducing agent-containing layer used in COMPARATIVE EXAMPLES 1 to 6 and INVENTION EXAMPLES 1 to 4 to a R01 coating weight of 0.65 g/m$^2$.

Thermographic Evaluation

Thermographic evaluation of the thermographic materials of INVENTION EXAMPLES 24 to 33 was carried out as described above for COMPARATIVE EXAMPLES 1 to 6 and INVENTION EXAMPLES 1 to 4 and the results are summarized in table 12 below.

TABLE 12

| Invention Example Nr | AgBeh coverage [g/m$^2$] | polymer latex nr | Surfactant Nr. | Surfactant [% by wt]* | Fresh $D_{max}/D_{min}$ (blue) | Archivability $\Delta D_{min}$ (blue) after 3d at 35° C./80% RH | Light Box $\Delta D_{min}$ (blue) after 3d at 30° C./85% RH |
|---|---|---|---|---|---|---|---|
| 24 | 4.52 | 9 | 3 | 3.6 | 5.30/0.07 | +0.15 | +0.24 |
| 25 | 3.65 | 10 | 3 | 3.6 | 4.60/0.08 | +0.08 | +0.12 |
| 26 | 4.31 | 11 | 3 | 3.6 | 5.23/0.06 | +0.19 | +0.23 |
| 27 | 4.44 | 21 | 3 | 3.6 | 5.25/0.06 | +0.09 | +0.20 |
| 28 | 4.15 | 22 | 3 | 3.6 | 4.53/0.06 | +0.08 | +0.15 |
| 29 | 4.11 | 23 | 3 | 3.6 | 5.30/0.04 | +0.03 | +0.10 |
| 30 | 3.69 | 17 | 3 | 3.6 | 4.42/0.05 | +0.05 | +0.07 |
| 31 | 4.19 | 32 | 3 | 3.6 | 4.34/0.06 | +0.06 | +0.09 |
| 32 | 4.15 | 34 | 3 | 3.6 | 4.65/0.05 | +0.07 | +0.08 |
| 33 | 3.94 | 35 | 3 | 3.6 | 3.76/0.05 | +0.06 | +0.18 |

*with respect to the polymer latex

The results of the thermographic evaluation of the thermographic materials of INVENTION EXAMPLES 24 to 33 using binders which are water-dispersible film-forming polymers having covalently bonded ionic groups, according to the present invention, clearly demonstrate their improved archivability (=reduced $\Delta D_{min}$ values) compared with the thermographic materials of COMPARATIVE EXAMPLES 1 to 6 with conventional acrylic latexes according to the teaching of WO 94/16361.

INVENTION EXAMPLES 33 to 44

Preparation of Subbing Layer

A 0.34 mm thick polyethylene terephthalate sheet was coated to a thickness of 0.1 mm with a composition which after drying and longitudinal and transverse stretching produced a 175 μm thick support coated on with the following subbing-layer composition expressed as the coating weights of the ingredients present:

| | |
|---|---|
| # copolymer of terephthalic acid/isophthalic acid/sulfoisophthalic acid/ethylene glycol (26.5/20/3.5/50): | 37.0 mg/m$^2$ |
| # copolymer latex of ethyl acrylate/methacrylic acid (80/20): | 3.0 mg/m$^2$ |
| # HORDAMER ™ PE02: | 1.0 mg/m$^2$ |
| # PAREZ RESIN ™ 707: | 7.0 mg/m$^2$ |

Preparation of a Silver Behenate Dispersion 9000 g of silver behenate were added with stirring to 9000 g of a 10% aqueous solution of Surfactant Nr 5 diluted with 20,146 g of deionized water and the mixture stirred for 30 minutes with a KOTTHOFF™ stirrer. The resulting dispersion was then passed four times through a MICROFLUIDICS™ M high pressure homogenizer at a pressure of 400 bar to obtain a finely divided aqueous silver behenate dispersion.

Preparation of a Tone Modifier Dispersion

The tone modifier dispersion was prepared by first dissolving 8.8 g of K7598 in 71.4 g of deionized water by first adding the gelatin, then allowing the gelatin to swell for 30 minutes and finally heating to 50° C. 20 g of T01 was added with ULTRA-TURRAX™ stirring to this gelatin solution at 50° C., and the stirring continued for a further 5 minutes. Finally the resulting dispersion was pumped through a DYNOMILL™ (a horizontal bead mill from BACHOFEN) for 6 hours to produce the final tone modifier dispersion containing: 20% of T01 and 8.8% of gelatin.

Preparation of the Silver Behenate Emulsion Layers

The coating dispersions for the thermographic recording materials of INVENTION EXAMPLES 33 to 44 were prepared by first dissolving 1.9271 g of K7598 in deionized water at 38° C. (for the quantity of water see table 13), then adding with stirring to the warm K7598 solution: first 19.0 g of the silver behenate dispersion, then of 5.86 g of the tone modifier dispersion as flakes followed by 15 minutes of stirring, then the latex dispersion (for quantity, concentration and type see table 13), then 11.23 g of an aqueous ethonol solution (17.6% ethanol) containing 0.92 g of R02 and 0.62 g of boric acid and finally 1.310 g of a 3.7% by weight solution of formaldehyde to produce 60 g of a dispersion containing: 7.47% of silver behenate, 0.75% of Surfactant Nr 5, 4.04% of gelatin, 2.98% of polymer latex, 1.53% of R02, 1.03% of boric acid, 1.92% of T01 and 0.08% of formaldehyde.

TABLE 13

| Invention | Quantity | polymer latex | | |
|---|---|---|---|---|
| Example number | of water [g] | number | concentration [%] | weight [g] |
| 33 | 11.133 | 23 | 18.4 | 9.720 |
| 34 | 11.043 | 36 | 18.2 | 9.810 |
| 35 | 11.563 | 37 | 19.2 | 9.290 |
| 36 | 11.133 | 38 | 18.4 | 9.720 |
| 37 | 11.263 | 39 | 18.6 | 9.590 |
| 38 | 11.443 | 40 | 19.0 | 9.410 |
| 39 | 11.443 | 40* | 19.0 | 9.410 |
| 40 | 10.573 | 41 | 17.4 | 10.280 |
| 41 | 10.573 | 41* | 17.4 | 10.280 |
| 42 | 9.928 | 42 | 16.5 | 10.925 |
| 43 | 10.953 | 43 | 18.0 | 9.900 |
| 44 | 10.913 | 44 | 18.0 | 9.940 |

*pH adjusted to 5.5 the resulting emulsions were then doctor blade-coated to a wet thickness of 60 μm at a blade setting of 100 μm onto the 175 μm thick subbed polyethylene terephthalate support and dried for 10 minutes at 50° C. producing a silver behenate coverage of about 4.0 g/m$^2$.

Thermographic Evaluation

Thermographic evaluation of the thermographic recording materials of INVENTION EXAMPLES 33 to 44 was carried out as described for COMPARATIVE EXAMPLES 1 to 6 and INVENTION EXAMPLES 1 to 4 except that in addition the image tone was assessed on the basis of the L*, a* and b* CIELAB-values of fresh prints.

The L*, a* and b* CIELAB-values were determined by spectrophotometric measurements according to ASTM Norm E179-90 in a R(45/0) geometry with evaluation according to ASTM Norm E308-90. The L*, a*, and b* CIELAB-values of fresh prints of the thermographic recording materials of INVENTION EXAMPLES 33 to 44 at an optical density, D, of 2.0 are summarized in table 14.

TABLE 14

| Invention | CIELAB-values: freshly printed thermographic materials at D = 2.0 | | |
|---|---|---|---|
| Example Nr. | L* | a* | b* |
| 33 | 11 | 2 | 6.5 |
| 34 | 10 | 2 | 6 |
| 35 | 10 | 2.5 | 6.5 |
| 36 | 11 | 2 | 6 |
| 37 | 9 | 2.5 | 6.5 |
| 38 | 9 | 2.5 | 4.5 |
| 39 | 10 | 2.5 | 3.5 |
| 40 | 9 | 3 | 4 |

TABLE 14-continued

| Invention | CIELAB-values: freshly printed thermographic materials at D = 2.0 | | |
|---|---|---|---|
| Example Nr. | L* | a* | b* |
| 41 | 10 | 1.5 | 2 |
| 42 | 11 | 2.5 | 1 |
| 43 | 11 | 2 | 3 |
| 44 | 10 | 3.5 | 5 |

Colour neutrality on the basis of CIELAB-values corresponds to a* and b* values of zero, with a negative a*-value indicating a greenish image-tone becoming greener as a* becomes more negative, a positive a*-value indicating a reddish image-tone becoming redder as a* becomes more positive, a negative b*-value indicating a bluish image-tone becoming bluer as b* becomes more negative and a positive b*-value indicating a yellowish image-tone becoming yellower as b* becomes more positive. It is clear from the results in table 14 that prints produced with thermographic recording materials produced with latexes containing both covalently bonded ionic groups and covalently bonded moieties with one or more acid groups (INVENTION EXAMPLES 38 to 44) exhibit lower b*-values i.e. are less yellow than prints produced with thermographic recording materials produced with latexes containing covalently bonded ionic groups, but not covalently bonded moieties with one or more acid groups (INVENTION EXAMPLES 33 to 37).

The results of the archivability and light box tests for the thermographic recording materials of INVENTION EXAMPLES 33 to 44 are summarized in table 15.

TABLE 15

| Invention | AgBeh | FRESH | | Archivability $\Delta D_{min}$ vis/blue after 3d | Light box $\Delta D_{min}$ vis/blue after 3d |
|---|---|---|---|---|---|
| example number | cover-age [g/m$^2$] | $D_{max}$ vis/blue | $D_{min}$ vis/blue | at 35° C./80% RH | at 30° C./85% RH) |
| 33 | 3.92 | 4.04/4.10 | 0.08/0.10 | 0.01/0.02 | 0.04/0.03 |
| 34 | 3.98 | 2.74/2.92 | 0.07/0.09 | 0.02/0.03 | 0.04/0.08 |
| 35 | 3.95 | 3.95/4.13 | 0.07/0.10 | 0.01/0.01 | 0.04/0.09 |
| 36 | 3.98 | 4.10/4.30 | 0.08/0.10 | 0.01/0.01 | 0.03/0.06 |
| 37 | 4.11 | 4.04/4.23 | 0.09/0.11 | 0.00/0.02 | 0.04/0.07 |
| 38 | 3.98 | 4.05/3.91 | 0.08/0.11 | 0.01/0.01 | 0.03/0.05 |
| 39 | 3.61 | 3.46/3.33 | 0.09/0.11 | 0.00/0.01 | 0.04/0.09 |
| 40 | 3.79 | 2.62/2.53 | 0.09/0.10 | 0.00/0.02 | 0.06/0.10 |
| 41 | 3.77 | 3.08/2.97 | 0.09/0.11 | 0.00/0.02 | 0.04/0.07 |
| 42 | 3.98 | 2.78/2.58 | 0.09/0.11 | 0.02/0.05 | 0.05/0.09 |
| 43 | 4.14 | 3.79/3.76 | 0.08/0.10 | 0.00/0.02 | 0.05/0.09 |
| 44 | 4.40 | 3.72/3.95 | 0.09/0.11 | 0.00/0.01 | 0.04/0.08 |

The results of the thermographic evaluation of the thermographic materials of INVENTION EXAMPLES 33 to 44 demonstrate the excellent archivability and light box stability (=reduced $\Delta D_{min}$ values) with thermoraphic recording materials produced with latexes containing both covalently bonded ionic groups and covalently bonded moieties with one or more acid groups (INVENTION EXAMPLES 38 to 44) and with thermoraphic recording materials produced with latexes containing covalently bonded ionic groups, but not covalently bonded moieties with one or more acid groups (INVENTION EXAMPLES 33 to 37).

Having described in detail preferred embodiments of the current invention, it will now be apparent to those skilled in the art that numerous modifications can be made therein without departing from the scope of the invention as defined in the following claims.

What is claimed is:

1. A process for producing a substantially light-insensitive black and white thermographic material, comprising a support and a thermosensitive element which comprises a substantially light-insensitive organic silver salt, a reducing agent therefor in substantial working relationship therewith and a binder, wherein said binder is a water-dispersible film-forming polymer having monomer units comprising covalently bonded ionic groups selected from the group consisting of sulfonate, sulfinate, carboxylate, phosphate, quaternary ammonium, tertiary sulfonium, and quaternary phosphonium groups, said process comprising:

(i) producing an aqueous dispersion of particles of the substantially light-insensitive silver salt;

(ii) modifying said dispersion of the silver salt into another aqueous dispersion comprising the silver salt, the reducing agent, and the binder; and (iii) coating the aqueous dispersion recited in step (ii) onto the support.

2. The process of claim 1 wherein said binder is a water-dispersible film-forming polymer comprising an ionic monomer selected from the group consisting of potassium salt of N-[(4'-sulfobenzamido)-oxo-decyl]methacrylamide; sodium salt of vinyl 2-sulfohexadecanoate; ammonium N-(1',1'-dimethyl-2'-sulfo-ethyl)-acrylamide; ammonium 2-sulfo-ethyl methacrylate; poly(oxy-1,2-ethandiyl), α-sulfo-ω-[1-[(nonylphenoxy)methyl]-2-(2-propenyloxy) ethoxy]ammonium salt; sodium salt of N-(2'-sulfoethylamino-oxo-decyl)methacrylamide; sodium salt of 5-sulfo-isophthalic acid; 2-(N,N,N-triethylammonio)ethyl octyl maleate bromide; 2-(N-allyl-N,N-diethylammonio) ethyl hexadecyl maleate bromide; N-[(11-methacryloyloxy) undecyl]-4-methyl-pyridinium bromide; 1-[N,N-dimethyl-N-(2-hydroxyethyl)-ammonio]-11-(methacryloyloxy) undecane; 1-(N,N-dimethyl-N-dodecyl-ammonio)-2-(methacryloyloxy)ethane; and combinations thereof.

3. The process of claim 1, wherein said polymer comprises monomer units selected from the group consisting of N-[(4'-sulfobenzamido)-oxo-decyl]methacrylamide, vinyl 2-sulfohexadecano 1'-dimethyl-2'-sulfo-ethyl)-acrylamide, 2-sulfo-ethyl methacrylate, N-(2'-sulfoethylamino-oxo-decyl) methacrylamide, 5-sulfo-isophthalic acid; and combinations thereof.

4. The process of claim 1, wherein said monomer unit is N-[(4'-sulfobenzamido)-oxo-decyl]methacrylamide.

5. The process of claim 1, wherein said monomer unit is vinyl 2-sulfohexadecanoate.

6. The process of claim 1, wherein said monomer unit is 2-sulfo-ethylmethacrylate.

7. The process of claim 1, wherein said monomer unit is 5-sulfo-isophthalic acid.

8. The process of claim 1, wherein said polymer further comprises carboxylic acid monomer units.

9. The process of claim 3, wherein said carboxylic acid is selected from the group consisting of itaconic acid, methacrylic acid, isophthalic acid, and terephthalic acid.

10. The process of claim 1, wherein said polymer further comprises monomer units having cross-linking groups.

11. The process according to claim 5, wherein said cross-linking group is an acetoacetoxy group.

12. The process according to claim 1, wherein said polymer further comprises monomeLi units selected from the group consisting of acrylates, methaciylates, styrene, dienes, unsubstituted vinyl esters, substituted vinyl esters, polyols, polycarboxylic acids, and polyisocyanates.

13. The process according to claim 1, wherein said polymer is a polymer latex.

14. The process according to claim 1, wherein said thermosensitive element further comprises gelatin.

15. The process according to claim 1, wherein said thermographic material further comprises a protective layer.

16. The process according to claim 1, wherein said substantially light-insensitive organic silver salt is a silver salt of an organic carboxylic acid.

* * * * *